United States Patent [19]

Raynor

[11] Patent Number: 5,003,905

[45] Date of Patent: Apr. 2, 1991

[54] COLLAPSIBLE HATCH SCREEN

[76] Inventor: Peter H. Raynor, 30 E. 3rd St., Patchogue, N.Y. 11772

[21] Appl. No.: 450,813

[22] Filed: Dec. 14, 1989

[51] Int. Cl.[5] ..... B63B 19/12

[52] U.S. Cl. ..... 114/201 R; 160/377

[58] Field of Search ..... 114/173, 177, 178, 201 R; 296/97.8, 148, 149; 160/377; 49/62; 98/88.1

[56] References Cited

U.S. PATENT DOCUMENTS

| | | | |
|---|---|---|---|
| 498,868 | 6/1893 | Wagandt | 160/377 |
| 1,137,702 | 4/1915 | Crawford | 160/377 |
| 1,393,616 | 10/1921 | Foster | 160/377 |
| 1,571,661 | 2/1926 | Descoteau | 160/377 |
| 4,095,640 | 6/1978 | Beckerer, Jr. | 114/178 |

*Primary Examiner*—Jesûs D. Sotelo

*Attorney, Agent, or Firm*—Michael I. Kroll

[57] ABSTRACT

A collapsible hatch screen is provided to cover a hatch frame with a hatch cover on a boat and consists of a square shaped screen frame being rigid at all four sides and bendable at all four corners thereof, a square shaped piece of screening sized to fit within the screen frame and a square shaped border member which covers the screen frame and is attached to all four edges of said piece of screening so that the screen frame can be folded and rolled up into a compact configuration for storage.

7 Claims, 2 Drawing Sheets

COLLAPSIBLE HATCH SCREEN

BACKGROUND OF THE INVENTION

1. Field of the Invention

The instant invention relates generally to boat hatches and more specifically it relates to a collapsible hatch screen.

2. Description of the Prior Art

Numerous boat hatches have been provided in prior art that are adapted to include removable screens which are not foldable so that it makes storage more difficult. While these units may be suitable for the particular purpose to which they address, they would not be as suitable for the purposes of the present invention as heretofore described.

SUMMARY OF THE INVENTION

A primary object of the present invention is to provide a collapsible hatch screen that will overcome the shortcomings of the prior art devices.

Another object is to provide a collapsible hatch screen that can be folded and rolled up and placed into a storage pouch when not being used.

An additional object is to provide a collapsible hatch screen that can be quickly attached and removed from the frame of a boat hatch without using special tools and hardware.

A further object is to provide a collapsible hatch screen that is simple and easy to use.

A still further object is to provide a collapsible hatch screen that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
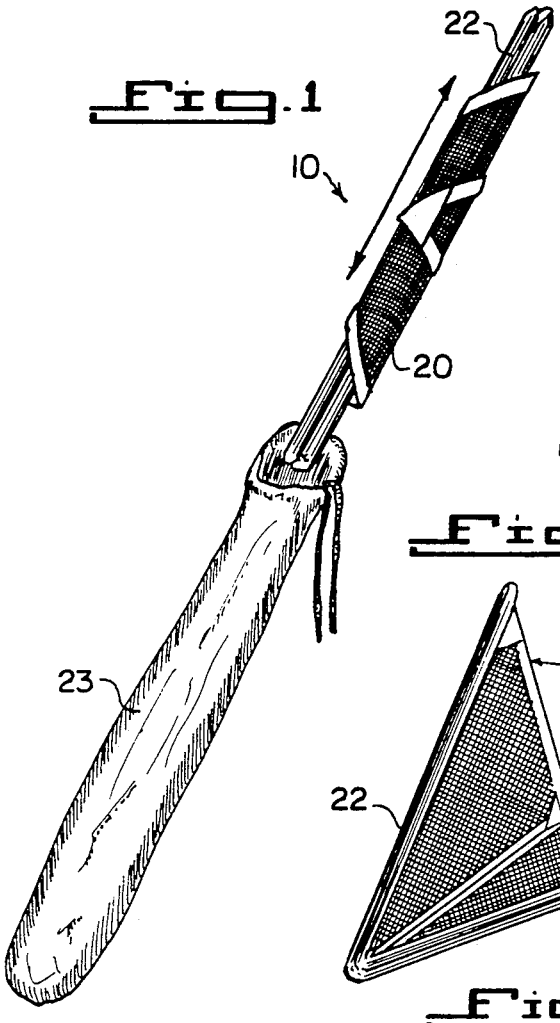
FIG. 1 is a perspective view of the invention in its completely folded stored position being removed from a pouch.
Figure 2:
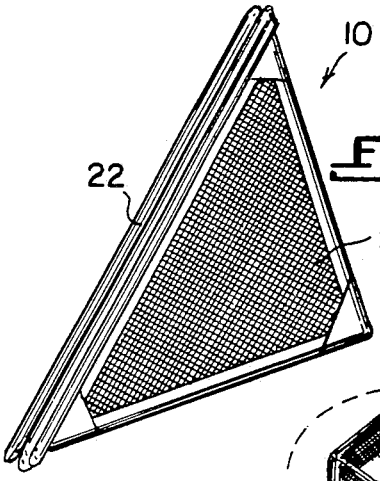
FIG. 2 is a perspective view of the invention partly unrolled into its folded in quartered position.
Figure 3:
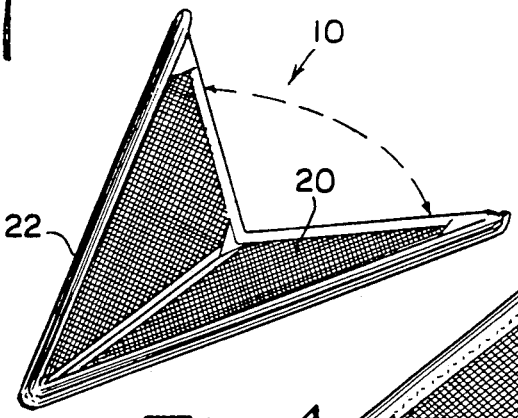
FIG. 3 is a perspective view of the invention being unfolded into its folded in half position.
Figure 5:
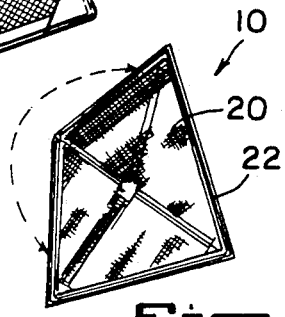
FIG. 5 is a perspective view of the invention being unfolded into its useable full position.
Figure 4:
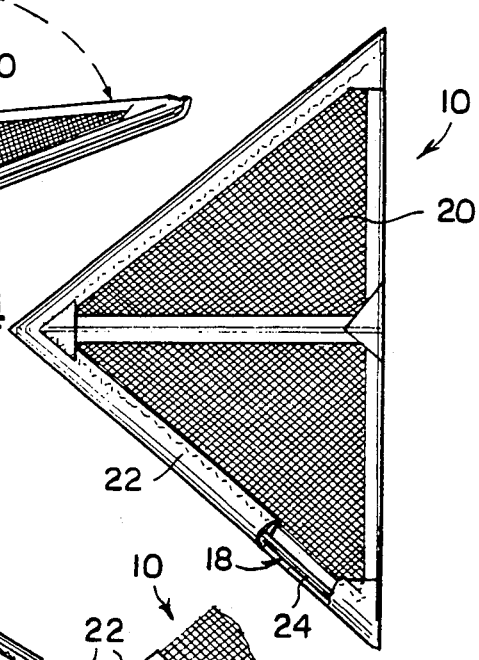
FIG. 4 is a top view of the invention in its folded in half position.
Figure 6:
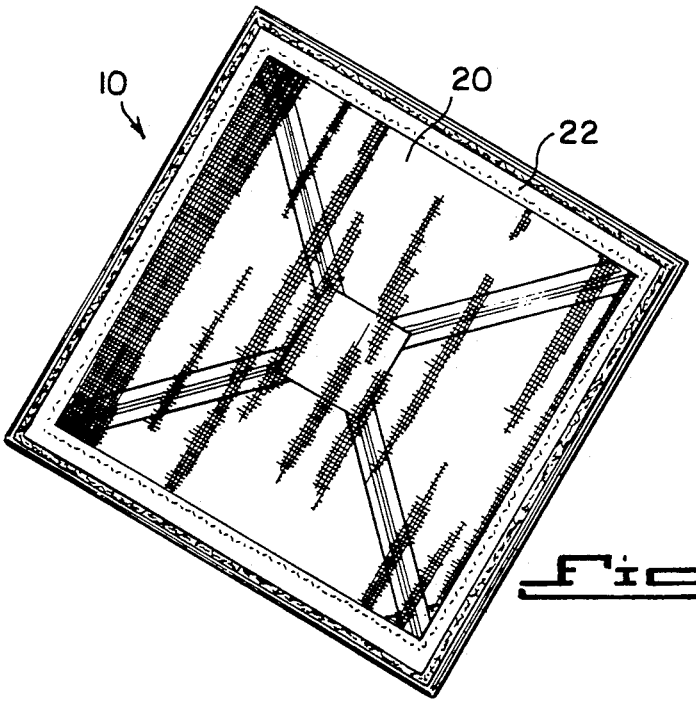
FIG. 6 is a top view of the invention in its useable full position.
Figure 7:
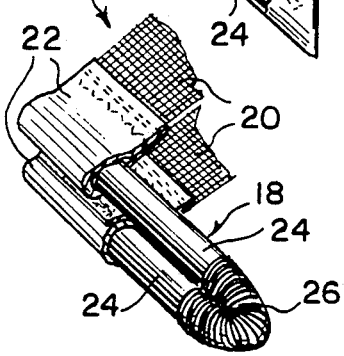
FIG. 7 is a perspective view of a portion of the invention in one of its folded positions showing one of the corner springs bent over.
Figure 8:
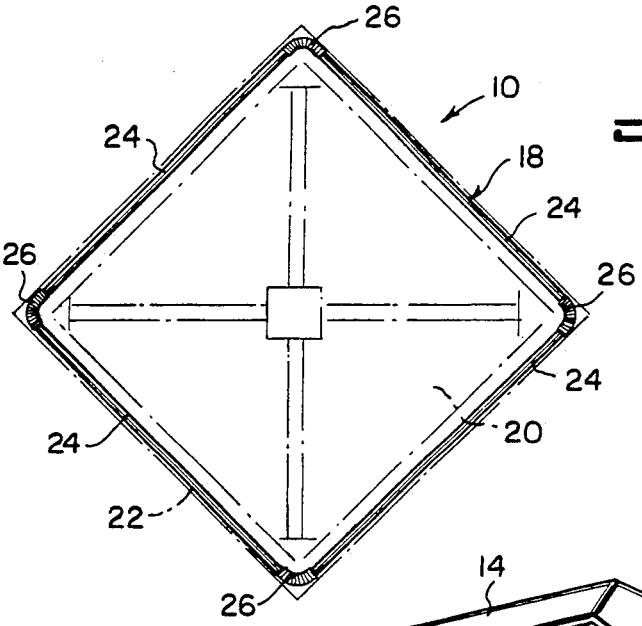
FIG. 8 is a top view of the screen frame showing the rest of the screen in phantom.

Turning now descriptively to the drawings, in which similar reference characters denote similar elements throughout the several views, FIGS. 1 through 11 illustrate a collapsible hatch screen 10 to cover a hatch frame 12 with a hatch cover 14 on a boat 16 consisting of a square shaped screen frame 18 being rigid at all four sides and bendable at all four corners thereof. A square shaped piece of screening 20 is sized to fit within the screen frame 18. A square shaped border member 22 is provided which covers the screen frame 18 and is attached to all four edges of the piece of screening 20 so that the screen frame 18 can be folded and rolled up into a compact configuration for storage. A pouch 23 is sized to receive the folded and rolled up collapsible hatch screen 10 for storage when not being used.

The screen frame 18 includes four rigid rods 24 and four springs 26, each joined end to end o nthe rods 24 to form the square shaped configuration. The border member 22 is typically fabricated out of nylon fabric material, while the piece of screening 20 is typically fabricated out of fiberglass flexible material.

Figure 11:
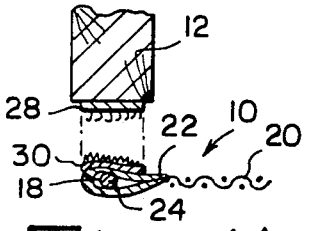
FIG. 11 is a cross sectional view with parts broken away of the boat hatch with the invention attached thereto directly with just the VELCRO.
Figure 9:
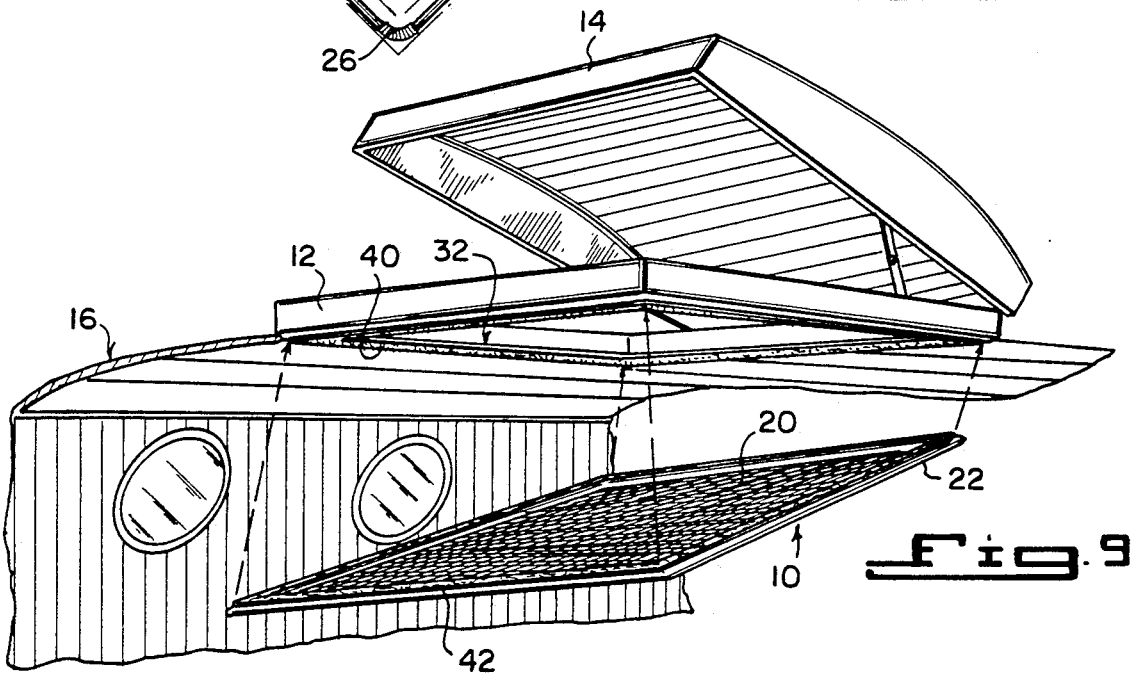
FIG. 9 is a perspective view of a boat hatch with the invention ready to be attached thereto.
Figure 10:
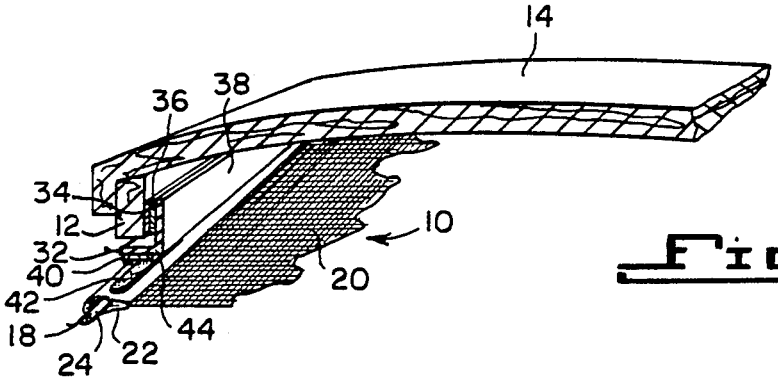
FIG. 10 is a cross sectional perspective view with parts broken away of the boat hatch with the invention attached thereto using an L-shaped bracket and VELCRO as shown in FIG. 9.

The border member 22 of the collapsible hatch screen 10 is removably attached to the hatch frame 12 to protect the opening below the hatch cover 14. As shown in FIG. 11, a pair of mating aligned juxtaposed hook and loop fabric fastener material strips 28 and 30 are between the perimeter of the border member 22 and the bottom of the hatch frame 12. As shown in FIGS. 9 and 10, an L-shaped bracket moulding 32 is sized to fit within the hatch frame 12. A first pair of mating aligned juxtaposed hook and loop fabric fastener material strips 34 and 36 are between the perimeter of one leg 38 of the L-shaped bracket moulding 32 and inner surface of the hatch frame 12. A second pair of mating aligned juxtaposed hook and loop fabric fastener material strips 40 and 42 are between the perimeter of the other leg 44 of the L-shaped bracket moulding 32 and the border member 22.

To use the collapsible hatch screen 10 a person simply removes it from the pouch 23 and then unrolls it and unfolds it as shown in FIGS. 1 through 6. The hatch screen 10 can then be placed onto the hatch frame 12 as shown in either FIGS. 9 and 10 or FIG. 11.

LIST OF REFERENCE NUMBERS

10 collapsible hatch screen
12 hatch frame
14 hatch cover
16 boat
18 screen frame
20 piece of screening
22 border member
23 pouch
24 rigid rod
26 spring
28 hook fabric material strip
30 loop fabric material strip
32 L-shaped bracket moulding
34 hook fabric material strip
36 loop fabric material strip

38 one leg of 32
40 hook fabric material strip
42 loop
44 other leg of 32

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A collapsible hatch screen to cover a hatch frame with a hatch cover on a boat comprising:

(a) a square shaped screen frame being rigid at all four sides and bendable at all four corners thereof;

(b) a square shaped piece of screening sized to fit within said screen frame;

(c) a square shaped border member which covers said screen frame and is attached to all four edges of said piece of screening so that said screen frame can be folded and rolled up into compact configuration for storage; and (d) a pouch sized to receive said folded and rolled up collapsible hatch screen for storage when not in use.

2. A collapsible hatch screen as recited in claim 1, wherein said screen frame includes:

(a) four rigid rods; and (b) four springs, each joined end to end on said rods to form the square shaped configuration.

3. A collapsible hatch screen as recited in claim 2, wherein said border member is fabricated out of nylon fabric material.

4. A collapsible hatch screen as recited in claim 3, wherein said piece of screening is fabricated out of fiberglass flexible material.

5. A collapsible hatch screen as recited in claim 4, further including means for removably attaching said border member to the hatch frame to protect the opening below the hatch cover.

6. A collapsible hatch screen as recited in claim 5, wherein said removably attaching means includes a pair of mating aligned juxtaposed hook and loop fabric fastener material strips between the perimeter of said border member and the bottom of the hatch frame.

7. A collapsible hatch screen as recited in claim 5, wherein said removably attaching means includes:

(a) an L-shaped bracket moulding sized to fit within the hatch frame;

(b) a first pair of mating aligned juxtaposed hook and loop fabric fastener material strips, between the perimeter of one leg of said L-shaped bracket moulding and inner surface of the hatch frame; and (c) a second pair of mating aligned juxtaposed hook and loop fabric fastener material strips, between the perimeter of other leg of said L-shaped bracket moulding and said border member.

* * * * *